US010499756B2

(12) United States Patent
Paige

(10) Patent No.: US 10,499,756 B2
(45) Date of Patent: Dec. 10, 2019

(54) POSITIONABLE CONTAINER SLEEVE

(71) Applicant: Jionni Paige, Denver, CO (US)

(72) Inventor: Jionni Paige, Denver, CO (US)

( * ) Notice: Subject to any disclaimer, the term of this patent is extended or adjusted under 35 U.S.C. 154(b) by 205 days.

(21) Appl. No.: 15/641,598

(22) Filed: Jul. 5, 2017

(65) Prior Publication Data

US 2018/0008072 A1 Jan. 11, 2018

Related U.S. Application Data

(60) Provisional application No. 62/360,050, filed on Jul. 8, 2016.

(51) Int. Cl.
*A47G 23/02* (2006.01)

(52) U.S. Cl.
CPC ..... *A47G 23/0225* (2013.01); *A47G 23/0241* (2013.01)

(58) Field of Classification Search
CPC ..... A47G 23/0225; A47G 23/0241; A47G 2023/0291
See application file for complete search history.

(56) References Cited

U.S. PATENT DOCUMENTS

| | | | | |
|---|---|---|---|---|
| 1,208,728 | A | | 12/1916 | Bartlett et al. |
| D296,987 | S | | 8/1988 | Rayner |
| D302,775 | S | | 8/1989 | Sinoff et al. |
| 4,852,762 | A | | 8/1989 | Chou-Sheng |
| D306,408 | S | | 3/1990 | Umbeck |
| D306,545 | S | | 3/1990 | Rosdick |
| D316,949 | S | | 5/1991 | Frizell |
| D325,494 | S | | 4/1992 | Gentry |
| 5,337,581 | A | | 8/1994 | Lott |
| D353,749 | S | | 12/1994 | Rozmiarek |
| D373,677 | S | * | 9/1996 | Kelly ..... D3/229 |
| 5,864,289 | A | | 1/1999 | Tiemann |
| D417,614 | S | | 12/1999 | Chu |
| 6,004,033 | A | | 12/1999 | Cirone |
| D426,461 | S | | 6/2000 | Noble |
| D431,322 | S | | 9/2000 | Lemoine |
| 6,193,202 | B1 | | 2/2001 | Rogers |
| 6,318,689 | B1 | | 11/2001 | Rodriguez |
| D466,685 | S | | 12/2002 | Gref |
| D466,809 | S | | 12/2002 | Sagel |
| D486,641 | S | | 2/2004 | Tagliati |

(Continued)

OTHER PUBLICATIONS

Kolder, "Bottle Insulators", http://www.kolder.com/bottleinsulators.html [Retrieved from the Internet on Mar. 17, 2017], Known as early as Oct. 12, 2015, 3 Pages.

(Continued)

*Primary Examiner* — Andrew T Kirsch
*Assistant Examiner* — Don M Anderson
(74) *Attorney, Agent, or Firm* — Dorsey & Whitney LLP

(57) ABSTRACT

A container sleeve is disclosed which include a body configured to hold a container. The body contains an attachment element that is concealed behind a cover, and is suitable for temporarily, but securely attaching the sleeve, container, and the container's contents to a vertical surface. The body and the cover over the attachment element have different coefficients of friction, optimized for their roles of gripping vertical surfaces, and human hands, respectively.

20 Claims, 14 Drawing Sheets

(56) References Cited

U.S. PATENT DOCUMENTS

| | | | |
|---|---|---|---|
| D506,056 | S | 6/2005 | Burns |
| 7,021,594 | B2 | 4/2006 | Exler |
| D526,190 | S | 8/2006 | Bolt et al. |
| D527,252 | S | 8/2006 | Bolt et al. |
| D540,679 | S | 4/2007 | Tanner |
| D557,008 | S | 12/2007 | Stiller |
| D585,305 | S | 1/2009 | Alvares et al. |
| D585,637 | S | 2/2009 | Schnackenberg |
| D591,589 | S | 5/2009 | Myers et al. |
| D592,529 | S | 5/2009 | Friebe et al. |
| D609,954 | S | 2/2010 | Barkdoll et al. |
| D630,843 | S | 1/2011 | Thibodeau |
| 7,897,088 | B2 | 3/2011 | Mitchell |
| D672,136 | S | 12/2012 | Martin |
| D675,881 | S | 2/2013 | Wamack, Jr. |
| D677,882 | S | 3/2013 | Inglis |
| D710,594 | S | 8/2014 | Vasquez et al. |
| D713,639 | S | 9/2014 | Whitlock et al. |
| D787,826 | S | 5/2017 | Clohessy |
| 2004/0021049 | A1 | 2/2004 | Payne et al. |
| 2004/0245415 | A1 | 12/2004 | Sun |
| 2005/0056655 | A1 | 3/2005 | Gary |
| 2006/0201956 | A1 | 9/2006 | Romo |
| 2009/0205542 | A1 | 8/2009 | Chang |
| 2013/0098954 | A1 | 4/2013 | Inglis |

OTHER PUBLICATIONS

Kolder, "Can Insulators", http://www.kolder.com/caninsulators.html [Retrieved from the Internet on Mar. 17, 2017], Known as early as Oct. 12, 2015, 3 Pages.

Kolder, "Kup Holder", http://www.kolder.com/kupholder.html [Retrieved from the Internet on Mar. 17, 2017], Known as early as Oct. 12, 2015, 3 Pages.

* cited by examiner

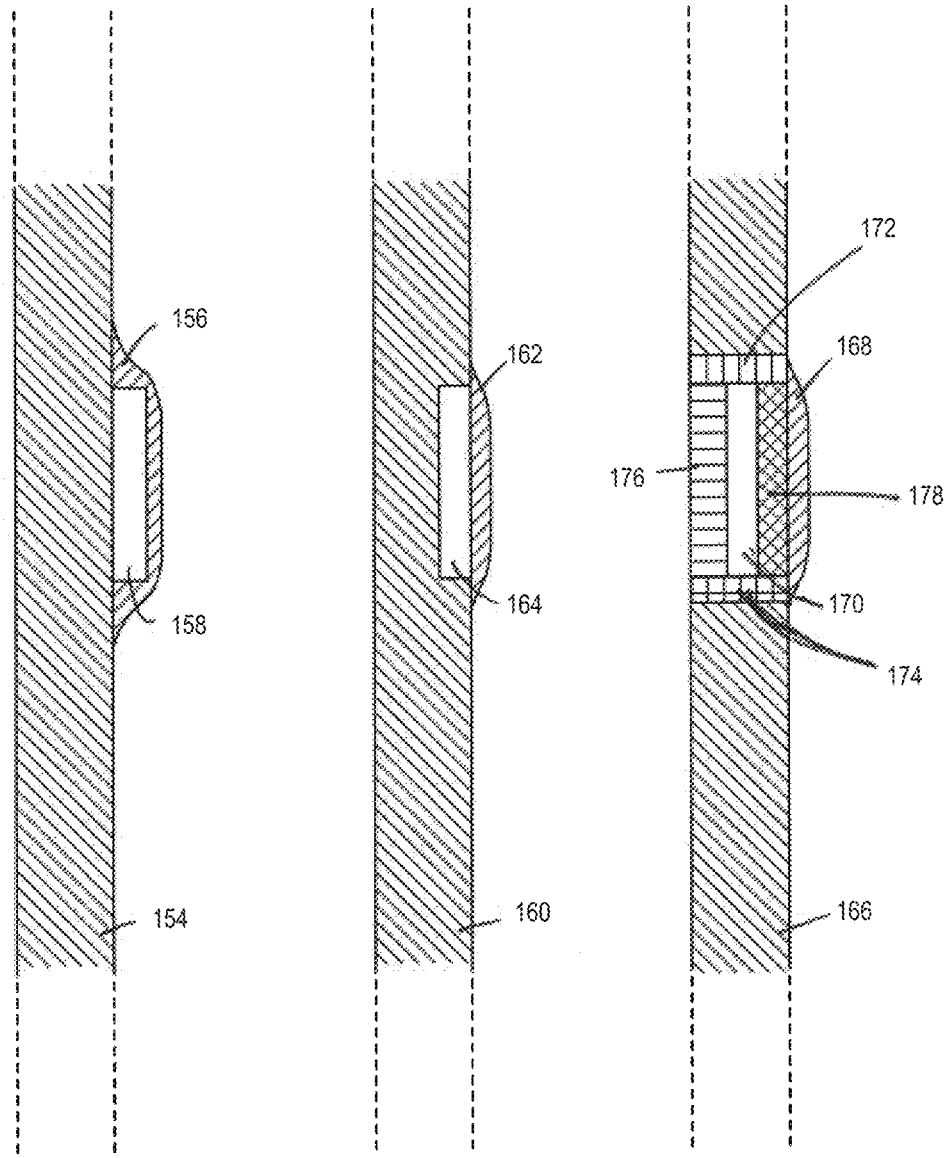
Fig. 9A Fig. 9B Fig. 9C
Alternate embodiments of section 9–9 of Fig. 2.
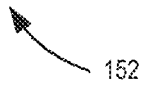

POSITIONABLE CONTAINER SLEEVE

CROSS REFERENCE TO RELATED APPLICATIONS

This application claims priority under 35 U.S.C. § 120 to U.S. provisional application No. 62/360,050, filed on Jul. 8, 2016, entitled "Magnetic Container Holder and Support," which is hereby incorporated by reference herein in its entirety.

This application is also related to U.S. design application No. 29/570,520 entitled "Container Holder," filed on Jul. 8, 2016, which is also incorporated by reference herein in its entirety.

TECHNICAL FIELD

This disclosure relates generally to the field of fluid container sleeves.

BACKGROUND

People frequently use personal, fluid containers in a variety of situations, such as during physical exercise where the fluid is a beverage. However, while people are exercising, they may need to put the container down and may not have a convenient place to do so and so may put the container in a location where it could spill, be damaged, or cause a trip hazard.

The information included in this Background section of the specification, including any references cited herein and any description or discussion thereof, is included for technical reference purposes only and is not to be regarded as subject matter by which the scope of the invention as defined in the claims is to be bound.

SUMMARY

A fluid container sleeve is disclosed. The sleeve has a body with an interior surface and an exterior surface which define a body. These surfaces define a volume suitable for holding a fluid container. An attachment element is coupled to the body. The attachment element exerts a magnetic pull force. A cover is attached to the exterior surface of the body and positioned to at least partially enclose the attachment element. The cover supports the combined weight of at least the container, any fluid in the container, the attachment element, and the cover. The cover has a coefficient of friction that is at least the ratio of the combined weight divided by the magnetic pull force.

In another embodiment, a container sleeve is disclosed. The sleeve has an interior and an exterior surface defining a body with an inner volume. An attachment element is attached to the body. The attachment element exerts a magnetic pull force sufficient to support the body and container in a predetermined position. A cap is connected to the body and positioned over a first surface of the attachment element so as to conceal the attachment element from the exterior surface of the body. The cap has a coefficient of friction larger than a coefficient of friction of the exterior surface of the body.

In yet another embodiment, a container sleeve is disclosed having a cylindrical body defined by an interior and an exterior surface. The interior surface defines an inner volume that holds a fluid container. The body has an open end and a closed end. An attachment element is coupled to the body wherein the attachment element exerts a magnetic pull force. A strap closes around the container at the open end. A strap adjuster adjusts a length of the strap and holds the length of the strap. A cover is attached to the exterior surface of the body and positioned to at least partially enclose the attachment element. The cover supports a combined weight of at least the container, the fluid in the container, the attachment element, and the cover. The cover has a coefficient of friction that is at least a ratio of the combined weight divided by the magnetic pull force, and the cover exerts an elastic force less than the magnetic pull force.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the present invention as defined in the claims is provided in the following written description of various embodiments of the invention, and illustrated in the accompanying drawings.

BRIEF DESCRIPTION OF THE DRAWINGS

FIGS. 9A, 9B, and 9C illustrate multiple cross sectional views of several embodiments of an attachment element in a container sleeve.

DETAILED DESCRIPTION

The present disclosure is generally directed toward a sleeve for holding a fluid container securely, but temporarily, to a surface. In one embodiment, the sleeve has a body with an interior and an exterior surface. The interior surface of the body defines an internal volume shaped and sized to support and hold a fluid container. In some embodiments, the inner volume may further be defined, at the bottom, by a bottom surface at least partially closing the bottom of the body. In some embodiments, the sleeve includes a strap and a strap adjuster, which may be dual purpose to define a carrying handle for a user and to cinch the top end of the sleeve around the fluid container to help hold the fluid container within the internal volume. In some embodiments, the cinching mechanism may be single purpose and a handle may not be included, e.g., an elastic element that tightens around the top end of the fluid container.

The body also includes an attachment element that exerts a pull force between the sleeve and a magnetic surface, the attachment element supports the sleeve and fluid container at a desired position and location. For example, the attachment element holds at least the combined weight of the sleeve, the fluid container, the fluid within the fluid container, the strap, and strap adjuster to the magnetic surface.

In some embodiments, a cover is attached to the exterior surface of the body and at least partially covers the attachment element. The cover may act to increase the frictional coefficient of the sleeve and in these embodiments may be selected such that the coefficient of static friction between the cover and the magnetic surface is at least the ratio of the combined weight of the sleeve, fluid container, and fluid, divided by the pull force exerted between the attachment element and the magnetic surface. The cover may be made of different materials depending on the relative coefficient of static friction desired between the cover and the magnetic surface, as well as aesthetic characteristics. For example, the cover may be a rubber material and the body may be a neoprene or similar material. In some embodiments, the attachment element may be disposed on the exterior surface of the body, within a recess in the body, or within a recess in the body surrounded from the rear, sides, or in front by materials different from the body, or different from the attachment element. In other embodiments, the cover may be formed integrally with the body or may be omitted.

In other embodiments, the cover may have a coefficient of friction that is substantially the same as the body. In these embodiments, the cover may act as a connection location identifier to alert a user where the sleeve should engage a support surface. In these embodiments, the cover may act to hold the attraction element within the sleeve and separate the attraction element from the environment.

Figure 1:
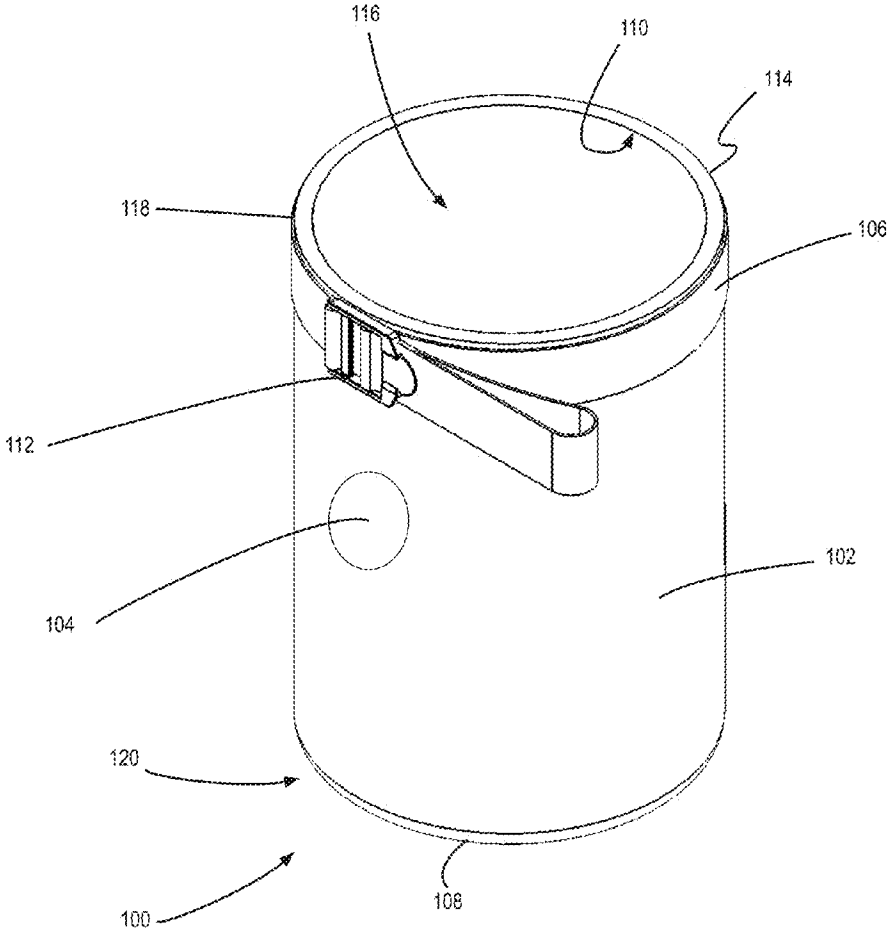
FIG. 1 is a front isometric view of one embodiment of a container sleeve.
Figure 2:
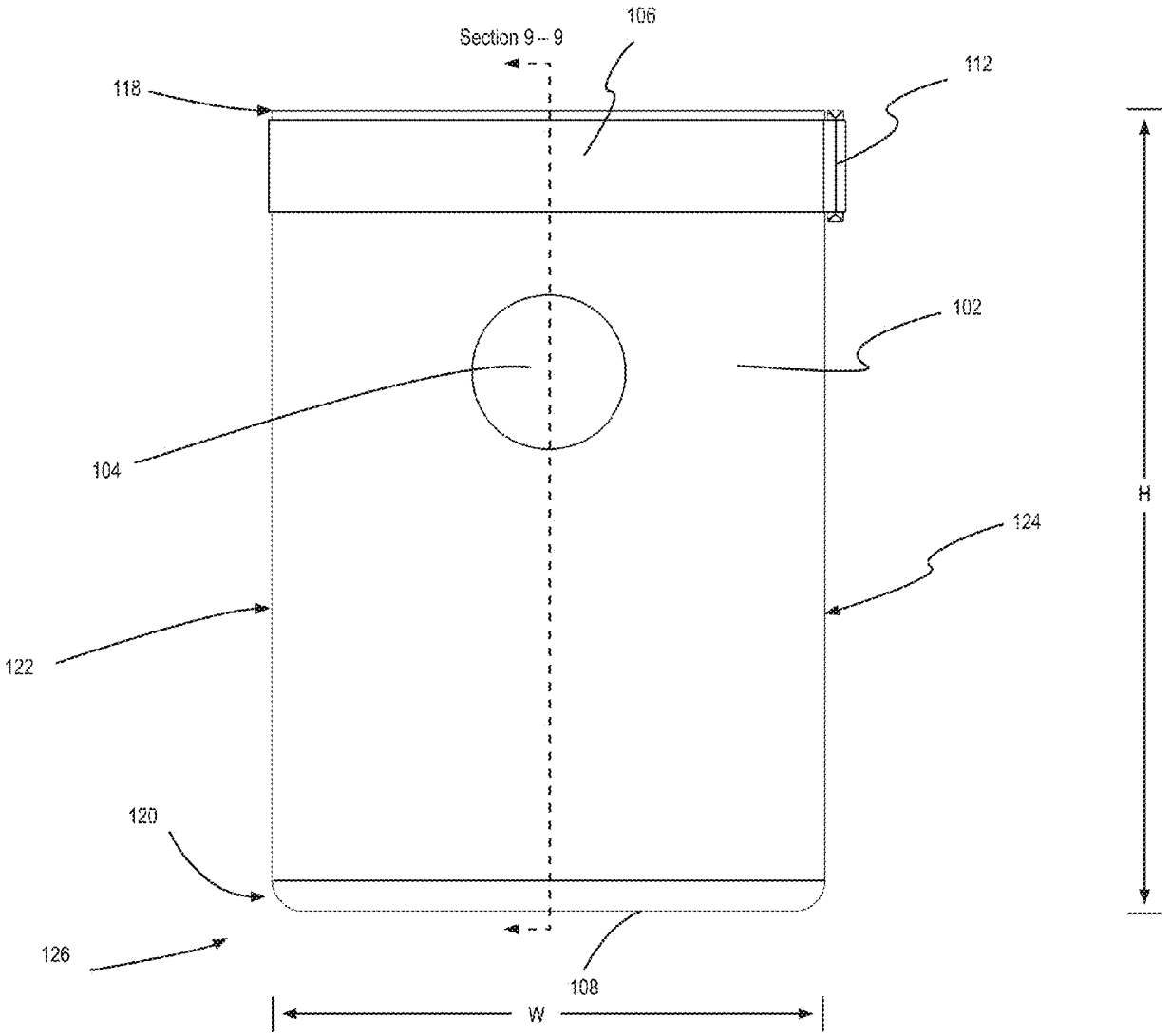
FIG. 2 is a front elevation view of one embodiment of a container sleeve.
Figure 3:
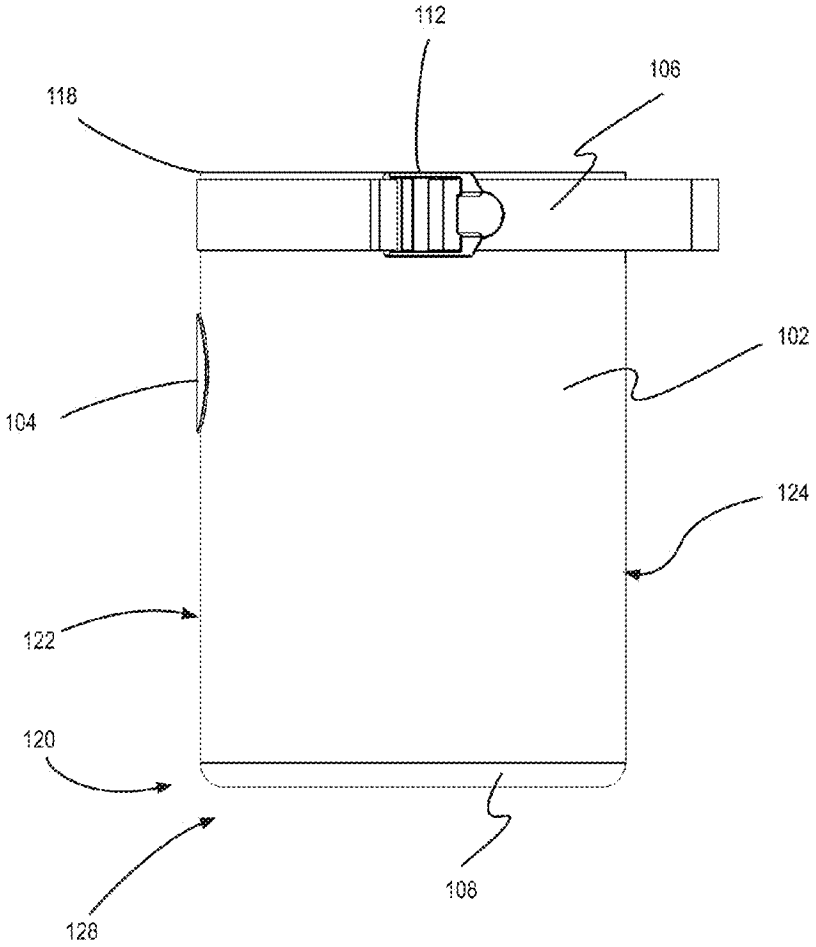
FIG. 3 is a side elevation view of one embodiment of a container sleeve.
Figure 4:
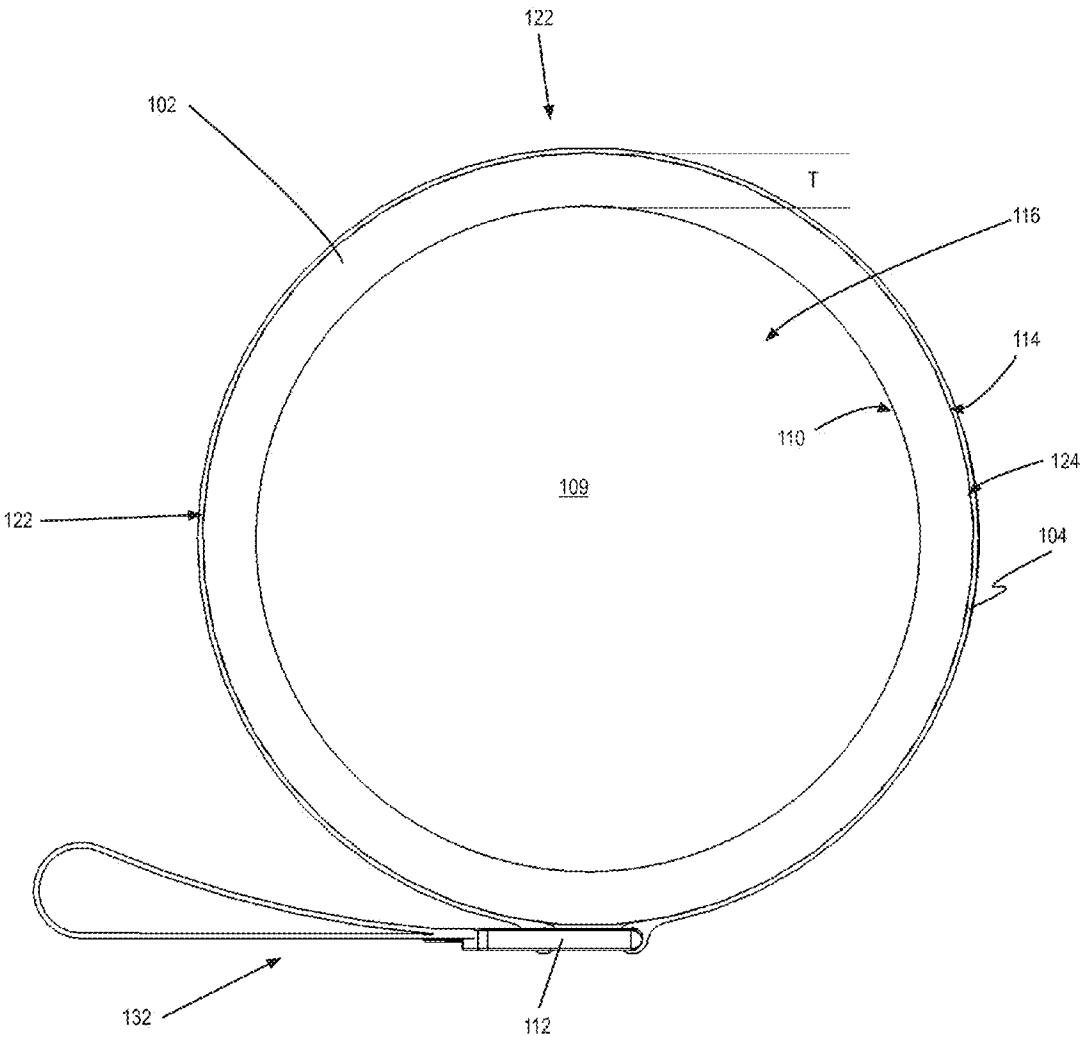
FIG. 4 is a top plan view of one embodiment of a container sleeve.
Figure 5:
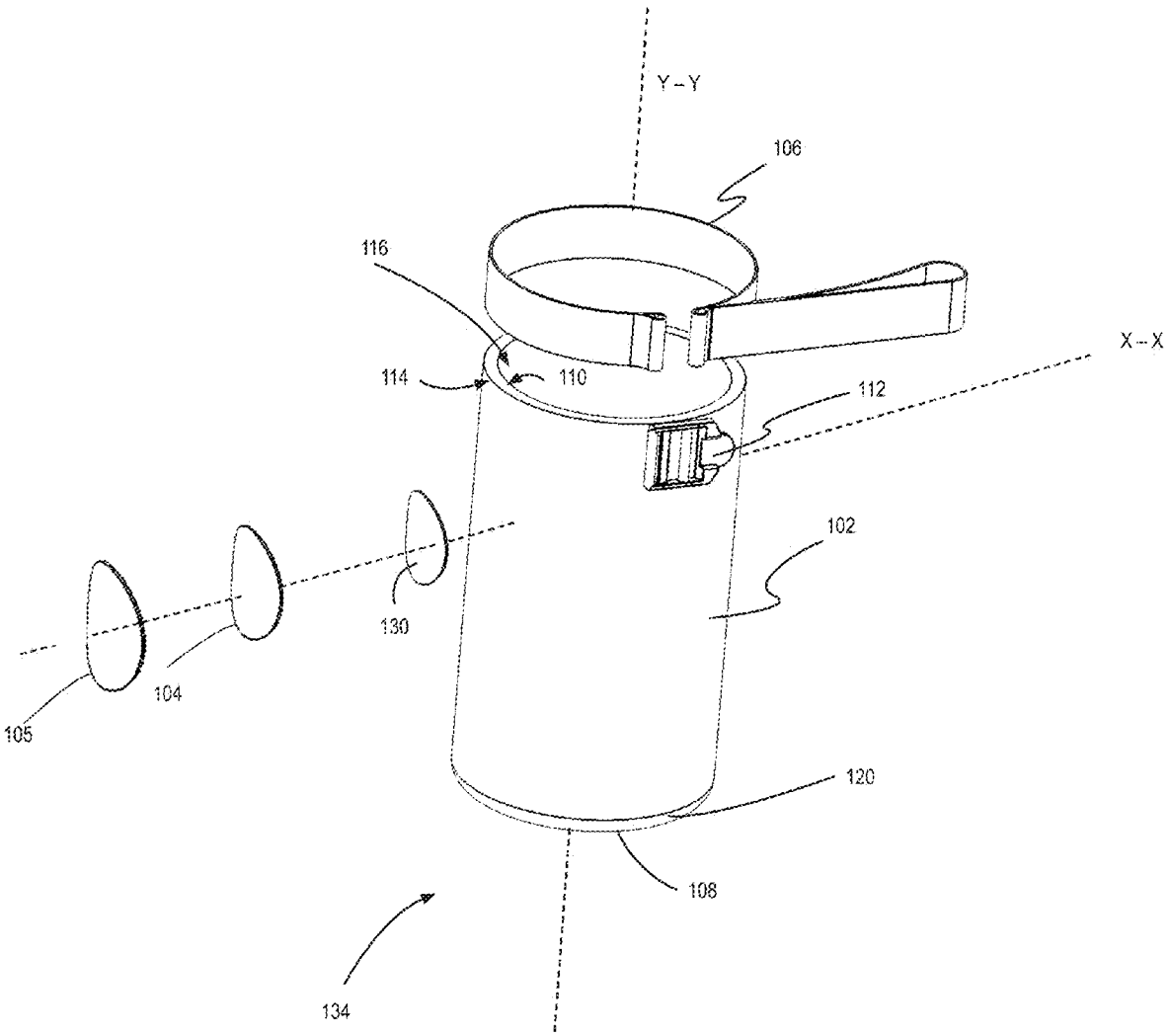
FIG. 5 is an exploded isometric view one embodiment of a container sleeve.

Turning to the figures, FIGS. 1-5 illustrate various views of a container sleeve. FIG. 1 illustrates a perspective view of a container sleeve 100, while FIGS. 2 and 3 illustrate elevation views of container sleeves 126 and 128, respectively. FIG. 4 illustrates a top plan view of a container sleeve 132, and FIG. 5 illustrates an exploded view of a container sleeve. It should be noted that while various features of the sleeve are discussed as particular functions, they may also be selected to have an aesthetically pleasing shape and configuration in order to be attractive and pleasing to a user. With reference to FIGS. 1-5, the container sleeve 100 includes a body 102, a strap 106, a strap adjuster 112, an attachment element 130, and a cover 104, each of which will be discussed in turn below.

The Body

The body 102 includes an interior surface 110 defining an inner volume 116 and an exterior surface 114. The interior surface 110 is separated from the exterior surface 114 by thickness, T, of the body 102. In various embodiments, the interior surface 110 defines an inner volume 116 to hold a container. The inner volume 116 may act as a storage compartment and be shaped and sized to receive various containers, such as, but not limited to, bottles, cups, flasks, cans, pouches, boxes, or the like. Containers may have a cylindrical shape with a circular, or near-circular, cross-sectional shape as seen from a top plan view or bottom plan view. In some cases, containers may have a polygonal or irregular shape. Accordingly, in some embodiments, the body 102 forms a generally cylindrical shape, but in other embodiments may be differently configured. In many embodiments, the body is formed of a sufficiently flexible and pliant material to allow, the body 102 to conform different shapes of fluid containers, such as various polygonal, prism-shaped containers, or other irregularly shaped containers. This allows the body to restrain the fluid container, but also may act to insulate the fluid container.

The body 102 may further have a height, H, and width, W, as shown with respect to FIG. 2. The height, H, extends from a bottom end 120 of the body 102 to a top end 118 of the body 102. The width, W, extends from a left side 122 of the body 102, to a right side 124 of the body 102. In some embodiments, the body 102 may have a height, H, allowing at least half of a height of a container to fit into the inner volume 116.

In some embodiments, the body 102 further has an opening, as shown in the top plan view of FIG. 4, and is closed at the bottom by an interior bottom surface 109 of a bottom end 120. In these embodiments, the body may prevent condensation that may accumulate around the fluid container from leaking from the sleeve 100. In other embodiments, the body 102 may be open, or partially closed at the bottom.

In some embodiments, the body 102 is made of a material having sufficient structural rigidity allowing the generally cylindrical shape to be maintained when the inner volume 116 is empty. Accordingly, in some embodiments, the container sleeve 100 may be a sleeve fitted around, or otherwise enclosing a container. The body 102 may also be pliable enough to conform to containers of various shapes and sizes. For example, the body 102 may fit around fluid containers of various sizes, such as fluid containers sized according to the volume of fluid they can hold. The body 102 may be configured to fit reusable and disposable bottles, cups, or cans of any size, or a range of sizes. In some embodiments, the body 102 may have elasticity to stretch around fluid containers having a larger diameter than the diameter of the body 102. In some cases, the body 102 may be optimized to fit a certain size of container, or a range of sizes determined by the degree by which the body 102 can stretch and deform.

In another aspect, the body 102 may also be made from an insulating material to reduce the rate of heat transfer between the fluid container and its surroundings, thereby keeping the temperature of the fluid in the fluid container substantially constant over a period of time. Insulating material may include, without limitation, suitable polymer foam having either closed or open-cell geometry. Accordingly, in various embodiments, the body 102 may be constructed from a fabric, expanded polymer foam, other suitable polymer material, or a combination of fabric and polymer material. For example, in some embodiments, the body 102 may include fabric created from, without limitation, polyester, nylon, polyurethane, or elastane. In further embodiments, the body 102 may include, without limitation, a polymer sheet or foam formed from latex rubber, nitrile rubber, expanded neoprene, styrene rubber, or other suitable synthetic rubbers, silicone, expanded polyurethane, ethylene-vinyl acetate, and polyvinyl chloride, and other polymers. In some embodiments, the body 102 may be a polymer sheet or foam lined on at least one of an exterior or interior surface with a fabric. In some further embodiments, a waterproof lining may be provided to cover all surfaces of the body 102 to prevent the buildup and trapping of moisture. In other embodiments, a porous open-cell foam may be utilized in the body 102 to allow moisture to escape from the body 102.

With reference to FIG. 5, in other embodiments, the body 102 may be extruded or molded into its shape. In some embodiments, the bottom end 120 may be a separate piece attached to the bottom of the body 102. The strap 106, strap adjuster 112, attachment element 130, and cover 140 may be attached to the body 102.

Figure 6:
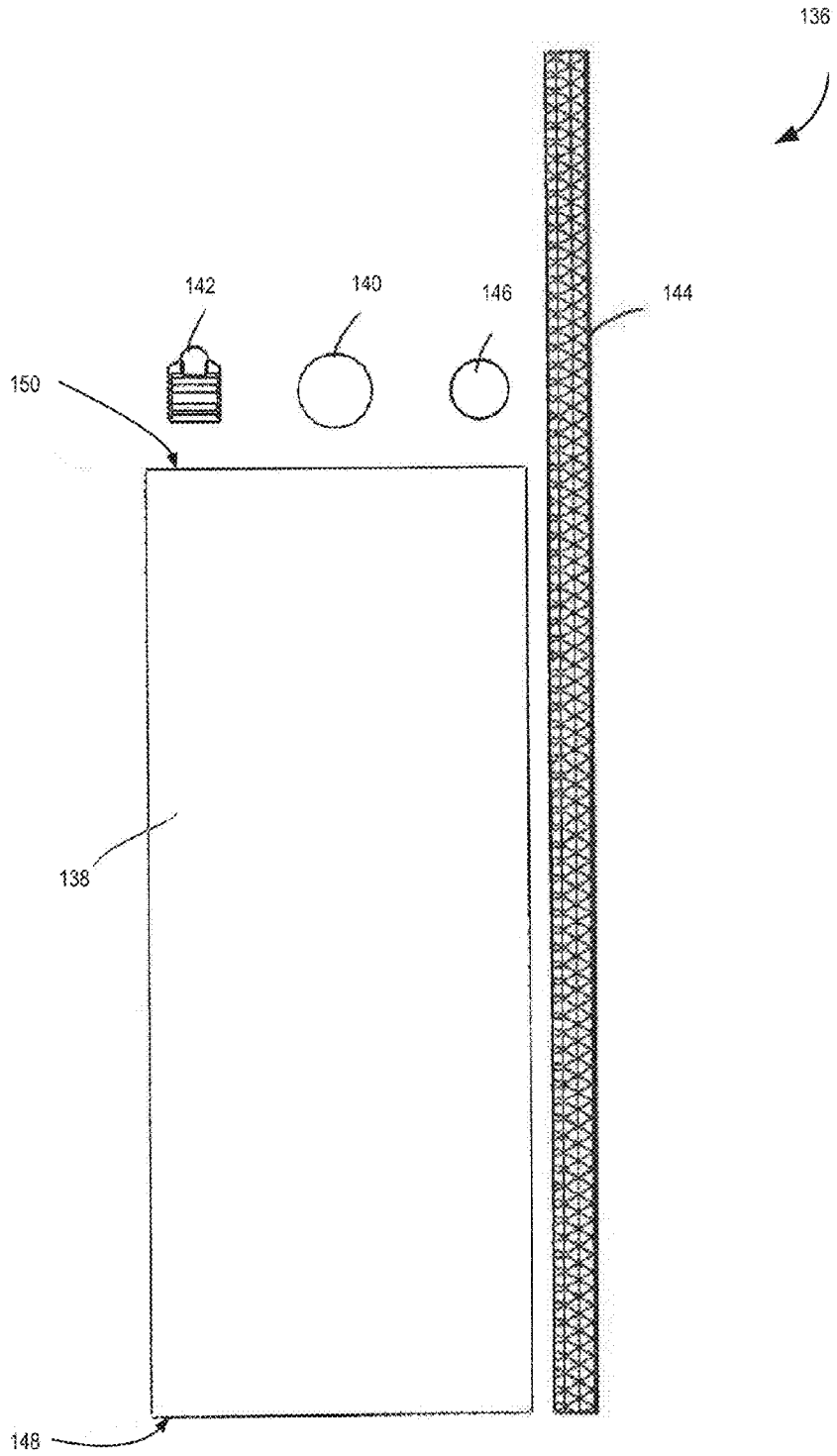
FIG. 6 is a deconstructed view of one embodiment of a container sleeve.

FIG. 6 illustrates a deconstructed container sleeve 136 according to various embodiments. The deconstructed container sleeve 136 may include body 138, cover 140, strap 144, strap adjuster 142, and attachment element 146. The body 138 may be constructed from a single sheet of polymer material. The polymer sheet may be generally rectangular, having a length and a width. The polymer sheet may have a first end 148 and a second end 150 separated by the length. The body 138 may be rolled widthwise into a cylindrical shape, with first and second ends 148, 150 attached together. Attachment of the first and second ends may include, without limitation, stitching, pressing, fusing, or bonding of first and second ends.

Figure 7:
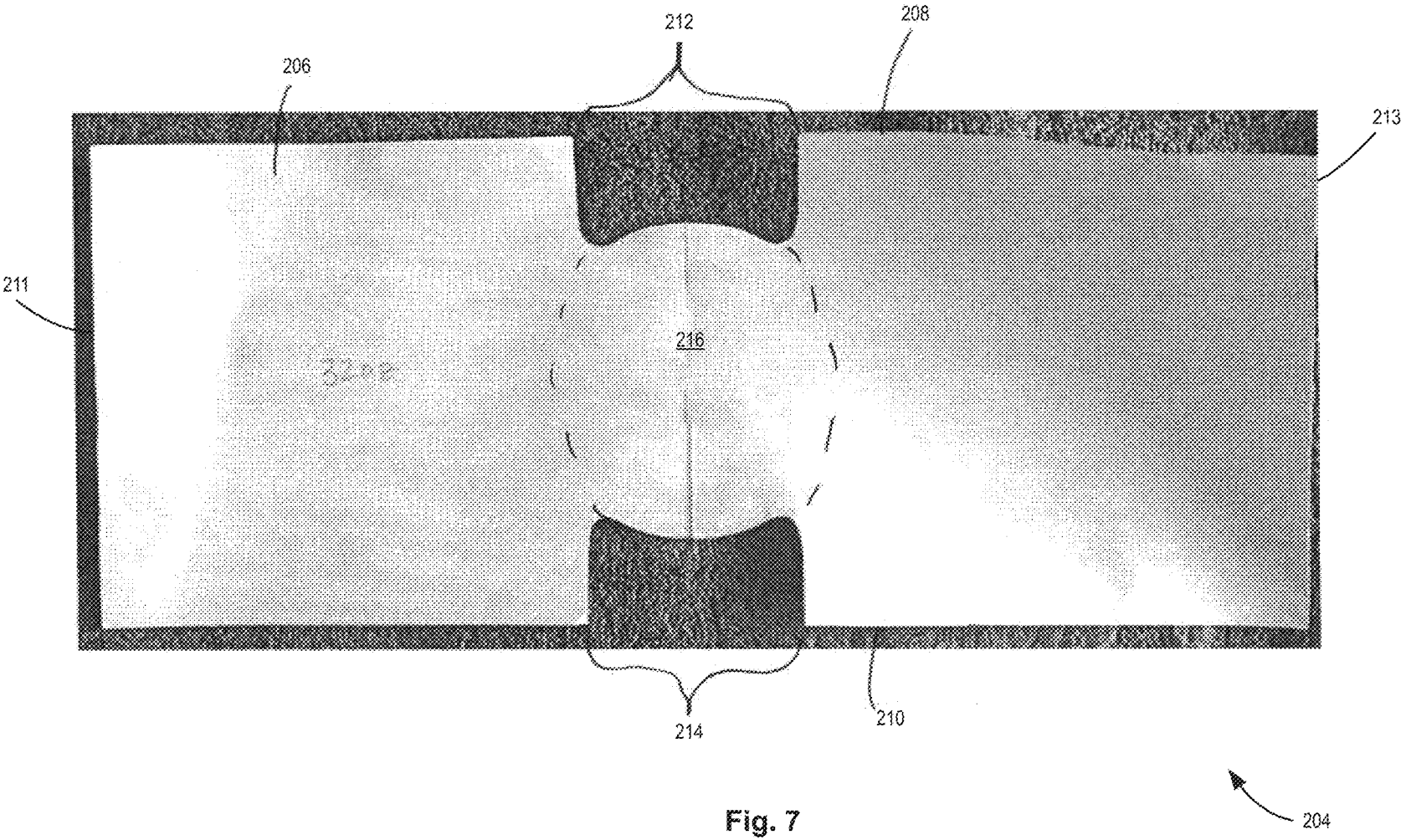
FIG. 7 is a deconstructed alternate embodiment of a container sleeve.

With reference to FIGS. 1, 2, 3, 5 and 7, in an alternative set of embodiments, bottom end 120 of a container sleeve 204 may be part of polymer sheet itself. FIG. 7 illustrates one such polymer sheet 206, according to various embodiments. The polymer sheet 206 may have a left edge 208 and a right edge 210 extending in a lengthwise direction, and a top edge 211 and a bottom edge 213, extending in the widthwise direction. The polymer sheet may therefore further include a first cutout 212 disposed approximately centrally along the left edge 208, and a second cutout 214 disposed approximately centrally along the right edge 210. The left edge 208 and right edge 210 may thus be divided, by the first and second cutouts, respectively, into top and bottom halves. The polymer sheet may thus be folded in half, widthwise, with the top half of the left edge 208 attached to the bottom half of the left edge 208, and the top half of the right edge 210 similarly attached to the bottom half of the right edge 210. For example, in one set of embodiments, the left edge 208 may be stitched, or bonded to itself, and the right edge 210 may similarly be stitched or bonded to itself. When constructed in this manner, the center area 216, defined on either side by the first and second cutouts 212, 214, may be the bottom end 120 with respect to FIGS. 1, 2, 3, and 5.

Figure 8B:
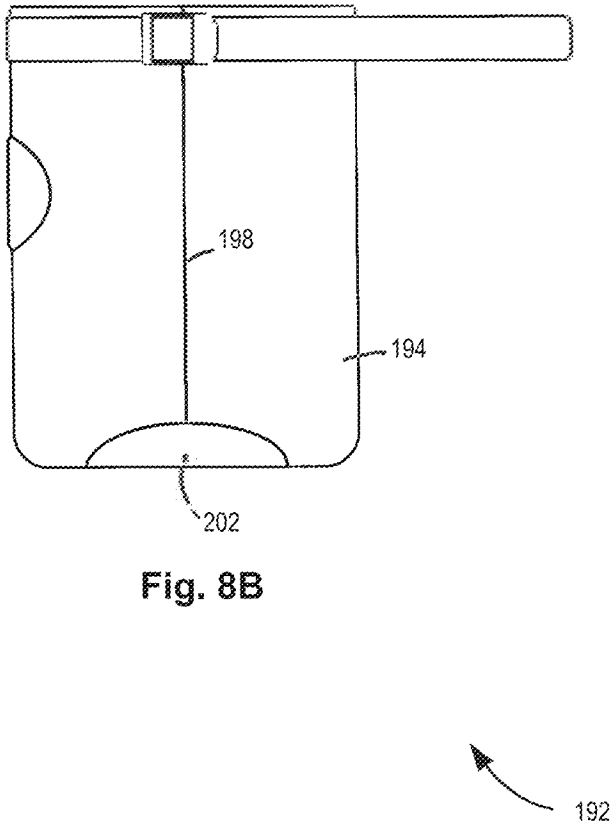
FIGS. 8A and 8B illustrate front and side elevation views of an alternative embodiment of a container sleeve.
Figure 8A:
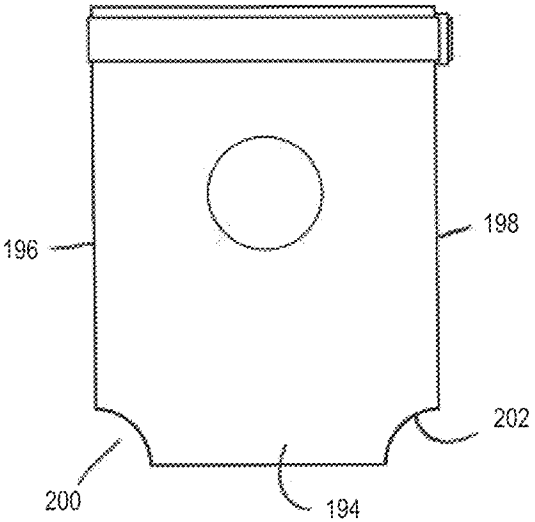

FIGS. 8A, and 9B illustrate a front plan view and a side plan view of a container sleeve 192 having body 194 constructed from the polymer sheet 206 of FIG. 7. Here, the first cutout 200 corresponds to first cutout 212 disposed centrally along the left edge 196, and a second cutout 202 corresponds to the second cutout 214 disposed centrally along the right edge 198, after the left edge 196 and right edge 198 have respectively been attached together. According to some embodiments, the first cutout 200 and second cutout 202 may be stitched or bonded shut. This can be seen with respect to FIG. 13, described in further detail below.

The Handle and Cinching Features

The sleeve container may also include one or more features that assist a user in carrying and enclosing the fluid container. For example, a handle may be connected to the sleeve, such as a strap, loop, or the like, that allows a user to grasp the sleeve at a particular location and that may not require a user to fit his or her hand around the diameter of the fluid container and sleeve. Additionally or alternatively, the sleeve may also include a cinching or enclosing feature that encloses a top end of the sleeve around the fluid container. This helps to ensure that the fluid container remains within the compartment, even if the sleeve is turned upside down or rotated.

In some embodiments, the cinching mechanism and carrying feature may be integrated in a dual purpose strap. For example, with reference to FIGS. 1-5, strap 106 may be coupled to the body 102 and in some embodiments, the strap 106 may be adjustably positioned around the body 102 in order to cinch or close the top opening of the body around the fluid container. The strap 106 may be tightened or loosened around the body 102 via strap adjuster 112 or cinching mechanism, which in some embodiments may be a buckle, fastener, or the like. In various embodiments, the strap 106 may be elastic or inelastic. For example, without limitation, the strap 106 may be made of polyester, nylon, leather, jute, metal, fiberglass, or other polymer or natural materials. The strap adjuster 112 may be configured to allow the length of the strap 106 to be adjusted, and to maintain the length of the strap 106 at a desired position. Accordingly, the strap adjuster 112 may include quick release buckles, ratcheting buckles, and ladder buckles.

Figure 14:
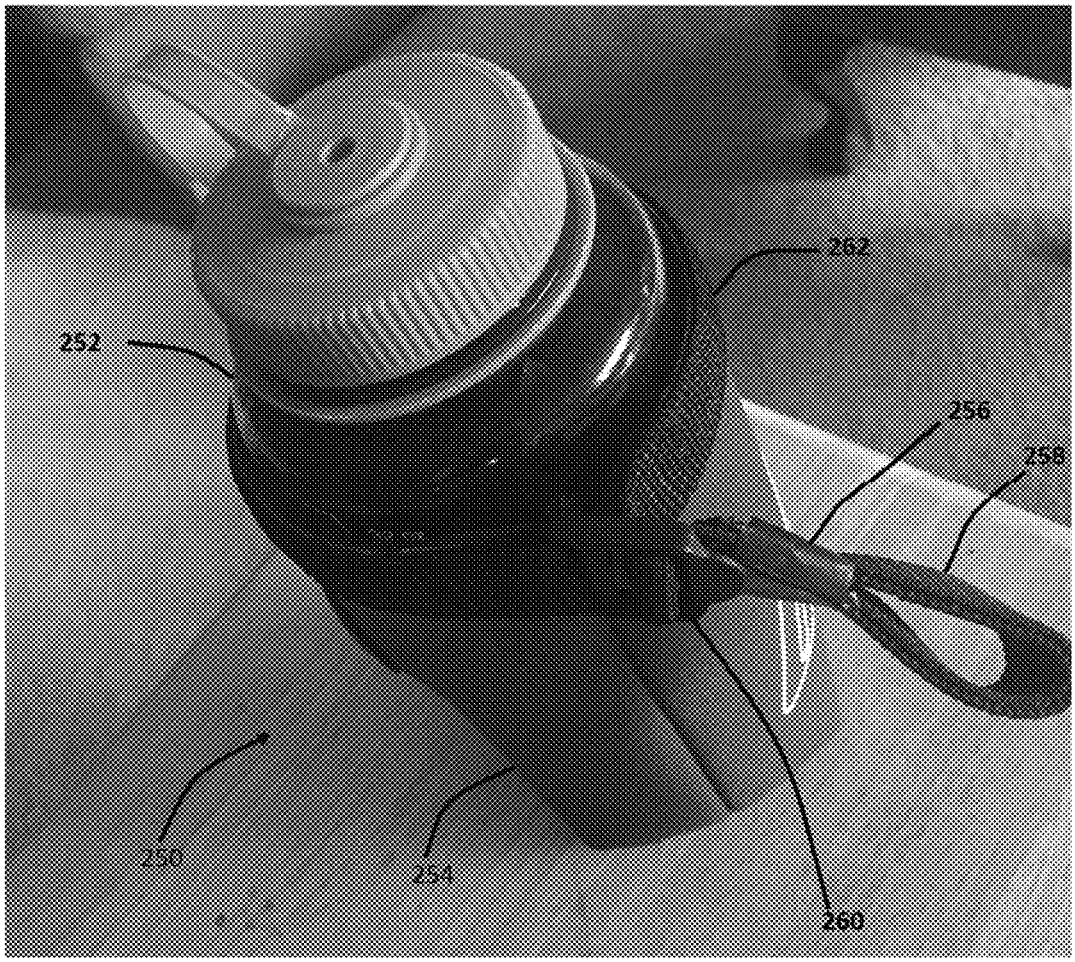
FIG. 14 illustrates an embodiment of a container sleeve of FIG. 1 holding a container with a strap tightened, having a first and a second cinching feature.

With reference to FIG. 14, in some embodiments, the sleeve 250 may have a first cinching feature 260 and a second cinching feature 256. The first cinching feature 260 cinches a strap 262 around a body 254 of the sleeve 250 and a fluid container 252, holding the fluid container 252 in the body 254 of the sleeve 250. The second cinching feature adjusts the size a loop 258 in a strap 262 to make it a suitable length for hooking over specific objects. For example, without limitation, the second cinching feature 256 may adjust the loop 258 to different length to hook over a coat hook, a door knob, handle, protrusion, a user's finger, a hanger, or other suitable feature.

With reference to FIGS. 1-5, and 14, in some alternative embodiments, instead of a strap 106, a cinching cord may be provided. The cinch cord may be elastic or inelastic. For example, without limitation, the cinch cord may be made of polyester, nylon, leather, jute, metal, fiberglass, or other polymer or natural materials.

The Attachment Element

With reference to FIG. 5, in other embodiments, an attachment element 130 may be attached to, coupled to, or recessed within the body. The attachment element 120 may be a magnetic element having a substantially plate-like or disc-like structure with at least one planar surface configured to magnetically couple to a magnetic surface. In various embodiments, the attachment element 130 may include ferrite magnets and/or rare earth magnets, such as, without limitation, neodymium magnets. With reference to FIG. 9A, in some embodiments, the attachment elements 158, 164, and 170 may be coupled to or recessed into the body 154, 160, 166 in various ways. For example, in one set of embodiments, the attachment element 158 may be positioned to be adjacent to an exterior surface of the body 154, and confined within a pocket defined by the cover 156 and exterior surface of the body 154.

With reference to FIG. 9B, in a further set of embodiments, labeled the attachment element 164 may alternatively be positioned within a recess in the exterior surface of the body 160. The recess may then be covered by cover 162, thus securing attachment element 164 in the recess.

With reference to FIG. 9C, in another set of embodiments, the attachment element 170 may be disposed within the body 166, between an interior and exterior surface of the body 166. In configuration 9C, the attachment element 170 may be enclosed by one or more different materials above by top section 172, below by bottom section 174, behind by back section 176, and in front by front section 178. Front section 178 may be further enclosed with a cover 168. In some embodiments, sections 170 and 172 may be circumferential sections in contact with the circumferential edge of attachment element 170. Sections 170 and 172 may be the same width as the body 166, or they may be narrower. In some embodiments, top section 172, bottom section 174, back section 176, and front section 178 may be the same material, while in other embodiments, each of the sections 172, 174, 176, 178 may be different materials. For example, in some embodiments, the front and back sections 176, 178 may be a first material, while top and bottom sections 172 and 174 may be a second material. In some embodiments, additional materials may be utilized. In yet further embodiments, one or more of the various sections 172, 174, 176, and 178 may be the same material as that used in the body 166. In another embodiment, each of sections 172, 174, 176, and 178 may each be different materials. Accordingly, each of the sections 172, 174, 176, and 178 may be any of polyester, nylon, polyurethane, or elastane fabric, a polymer sheet or foam formed from latex rubber, nitrile rubber, expanded neoprene, styrene rubber, or other suitable synthetic rubbers, silicone, expanded polyurethane, ethylene-vinyl acetate, and polyvinyl chloride and other vinyl polymers, or a combination of fabric and polymer material.

With reference to FIG. 9C, alternately, sections 172, 174, 176, and 178 may be magnetic materials for example, without limitation, iron, nickel, cobalt, and alloys of the same. Using magnetic materials in this way will enable a larger contact area, amplifying the holding force of the attachment element, without requiring the use of a larger attachment element 178, thus saving cost, increasing stability of the container sleeve's contact on the surface to which it is attached, and enabling the sleeve to hold heavier containers than it could without those materials.

With reference to FIG. 9C, in other embodiments, sections 172, 174, 176, and 178 may be rigid non-magnetic materials for example, without limitation, such as copper, aluminum, brass, thermoplastics, thermosetting plastics, wood, stone, or leather. Materials for sections 172, 174, 176, and 178 may be chosen such that they act as an interface between the attachment element 178 and the body 166. For instance, if the body 166 material and the attachment element 178 material are incompatible chemically, or physically, or cannot be reliably bonded to one another, materials may be chosen for sections 172, 174, 176, and 178 that are compatible with both the material of the attachment element 178, and the body 166.

With reference to FIG. 9C, in other embodiments, sections 172, 174, 176, and 178 may be rigid non-magnetic materials for example, without limitation, such as copper, aluminum, brass, thermoplastics, thermosetting plastics, wood, stone, or leather. Materials for sections 172, 174, 176, and 178 may be chosen such that they act as an interface between the attachment element 178 and the body 166. For instance, if the body 166 material and the attachment element 178 material are incompatible chemically, or physically, or cannot be reliably bonded to one another, materials may be chosen for sections 172, 174, 176, and 178 that are compatible with both the material of the attachment element 178, and the body 166.

The Cover

With reference to FIGS. 1-5, in some embodiments, the cover 104 may be coupled to the body 102, securing the attachment element 130 to the body 102. In one set of embodiments, the cover 104 may define a pocket with the exterior surface 114 to hold the attachment element 130. The cover may act to enhance the connection between the sleeve and the support surface, e.g., may increase the coefficient of friction compared to either or both the body and the attachment mechanism.

With reference to FIG. 5, in various embodiments, attachment of the cover 104 may include, without limitation, stitching, pressing, fusing, or bonding. For example, in some embodiments, the cover 104 may be stitched to the body 102. In other embodiments, an adhesive may be used to attach the cover 104 to the body 102. In a further embodiment, the cover 104 may be bonded to the body 102 using other suitable techniques, including, without limitation, thermal bonding, chemical bonding, and the like. It will be appreciated by those skilled in the art that other techniques may be utilized to attach the magnetic cover 104 to the body 102, and that the above description should not be taken as limiting.

With reference to FIG. 5, in various embodiments, the cover 104 may be a sheet-like structure, having a size and shape configured to cover at least part of the attachment element 130 and secure the attachment element 130 against the body 102. Accordingly, in some embodiments, the cover 104 may be a cap that can be either flexible or rigid, covering or concealing the attachment element against the body 102. In some embodiments, the cover 104 may further be configured to support the weight of the container sleeve 100, a fluid container, and any fluid in the container. Accordingly, the cover 104 may be created from a material having sufficient strength to support the weight of a filled fluid container, repeatedly, without experiencing material failure or weakening, such as tearing, perforation, permanent deformation, or other structural failure. Furthermore, in some embodiments, the cover 104 may also have a coefficient of friction appropriate to keep the container sleeve 100 in place against a vertical or sloped surface. For example, in one set of embodiments, the cover 104 may have a coefficient of friction, relative to the magnetic surface, which is greater than or equal to a ratio of the combined weight of the container sleeve 100 and a filled fluid container (total weight "W"), and a pull force of the attachment element 130 ("F"). In other words, the coefficient of friction may be greater than or equal to the ratio of W/F. Accordingly, in some embodiments, the cover 104 may be created from an elastomer, or other suitable polymer material. Suitable materials may include, without limitation, latex rubber, nitrile rubber, neoprene or other suitable synthetic rubbers, silicone, polyurethane, ethylene-vinyl acetate, and polyvinyl chloride and other polymers.

With reference to FIG. 5, in other embodiments, the material of cover 104 may be chosen to maximize the coefficient of static friction between the cover 104, and typical surfaces to which the container sleeve 134 may be attached. In this way the coefficient of friction for the sleeve may be customized for different usage modes (i.e. holding mode and mounted mode). By way of example and for illustration only, to optimize the sleeve 134 for mounted mode, the cover 104 may be of a rough material like sand paper that does not easily slide along smooth surfaces. Alternately, the surface of cover 104 may possess horizontal ridges that resist sliding movement of the sleeve along an axis parallel to the axis Y-Y. However, materials that maximize friction between the mounting surface and the cover 104, may not be comfortable, ergonomic, nor aesthetically pleasing to hold. Therefore, to make the sleeve 134 appropriate for holding mode, the body 102 may be made of a material entirely different than the cover, a material that is easy and comfortable to hold.

With reference to FIG. 5, in other embodiments, the material of a first cover 104 may be further covered with second cover 105 made of the same, or a different material. By selecting the materials used for first cover 104 and second 105, different properties can be obtained. For example, without limitation, first cover 104 could be an elastomer such as rubber, expanded polymer foam, thermoplastic, or thermosetting plastic; and the second cover 105 could be a rugged, abrasion-resistant material such as woven nylon, aramid, polypropylene, or cotton fibers or blends of fibers. Also for example, without limitation, first cover 104 could be made of expanded polymer foam, and second cover 105 could be made of a material such as rubber, to enhance the coefficient friction, and also provide an elastic force when compressed by a magnetic pull force of the attachment element.

With reference to FIG. 9C, in some embodiments, cover 168 may be made of a spongy material with a low spring rate, or Young's or elastic modulus. Such a material will collapse under the magnetic pull force between the attachment element 170 and a magnetic surface. In so collapsing, the cover 168 will allow for a stable, flush attachment area between the sleeve 152 and the surface. In addition, depending on the Young's modulus of the cover 168 material, and its thickness, the cover 168 will generate a spring force opposed to that of the attachment element 170. This opposing force will enable a user to easily re-position the sleeve by helping to push the sleeve away from a magnetic surface.

Operating the Strap and Strap Adjuster

Figure 10B:
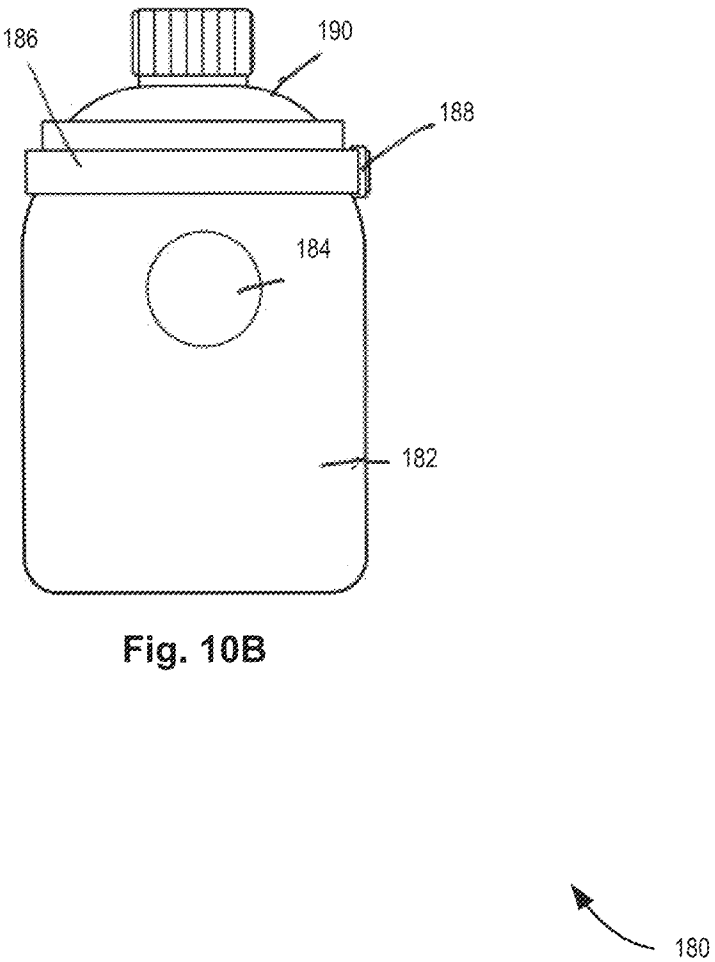
FIG. 10B is a front elevation view of one embodiment of a container sleeve holding a container, after a strap is tightened.
Figure 10A:
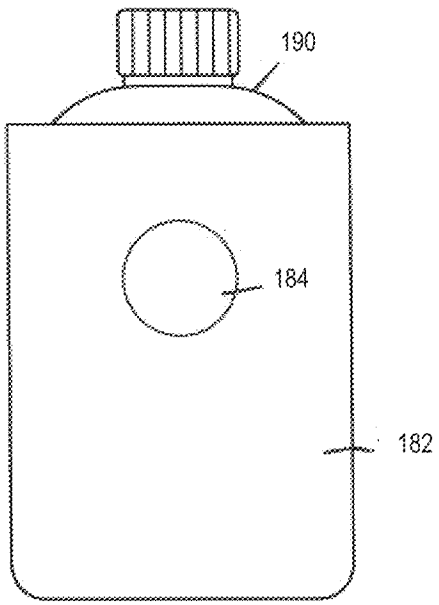
FIG. 10A is a front elevation view of one embodiment of a container sleeve holding a container, before a strap is tightened.

FIG. 10A illustrates a front elevation view of a container sleeve 180 for a fluid container before a strap 186 is adjusted with a strap adjuster 188. FIG. 10B illustrates a front elevation view of a container sleeve after a strap 186 is adjusted. In various embodiments, a fluid container 190 may be placed within the body 182 of the container sleeve 180. The body 182 may further have a cover 184 positioned on the exterior of the body 182. As illustrated in FIG. 10B, the body 182 may be secured to the fluid container 190 via strap 186 and strap adjuster 188. The strap 186 may be tightened around the fluid container 190, and locked in place via strap adjuster 188. In this manner, the strap 186 and strap adjuster 188 may be used to tighten the body 182 around a fluid container, preventing the body 182 from sliding off of the fluid container. In some further embodiments, the strap 186 may at least partially be attached circumferentially around the body 182.

Referring to FIG. 5, a cinch may be provided instead of a strap adjuster 112, to adjust the length of the cinching cord, and to maintain the desired length of the cinching cord. In some embodiments, a loop may be provided at an end of the strap 106 to serve as a handle, or to hang the container sleeve 100 from, for example, a protruding feature such as a hook, handle, pin, or other suitable part of an exercise machine.

Operating the Attachment Element and Cover

With respect to FIGS. 1 and 5 in various embodiments, the container sleeve 100 may be configured to attach to a magnetic surface. The magnetic surface may include, without limitation, the magnetic surface of a car, truck, motorcycle, an exercise machine or exercise equipment, home appliances, furniture, a bicycle frame, wall, or any other suitable surface upon which the attachment element 130 may exert a magnetic force. The container sleeve 100 may be attached to the magnetic surface via the attachment element 130 and cover 104. The cover 104 may be attached to the body 102, with attachment element 130 positioned between the cover 104 and the body 102.

Figure 11:
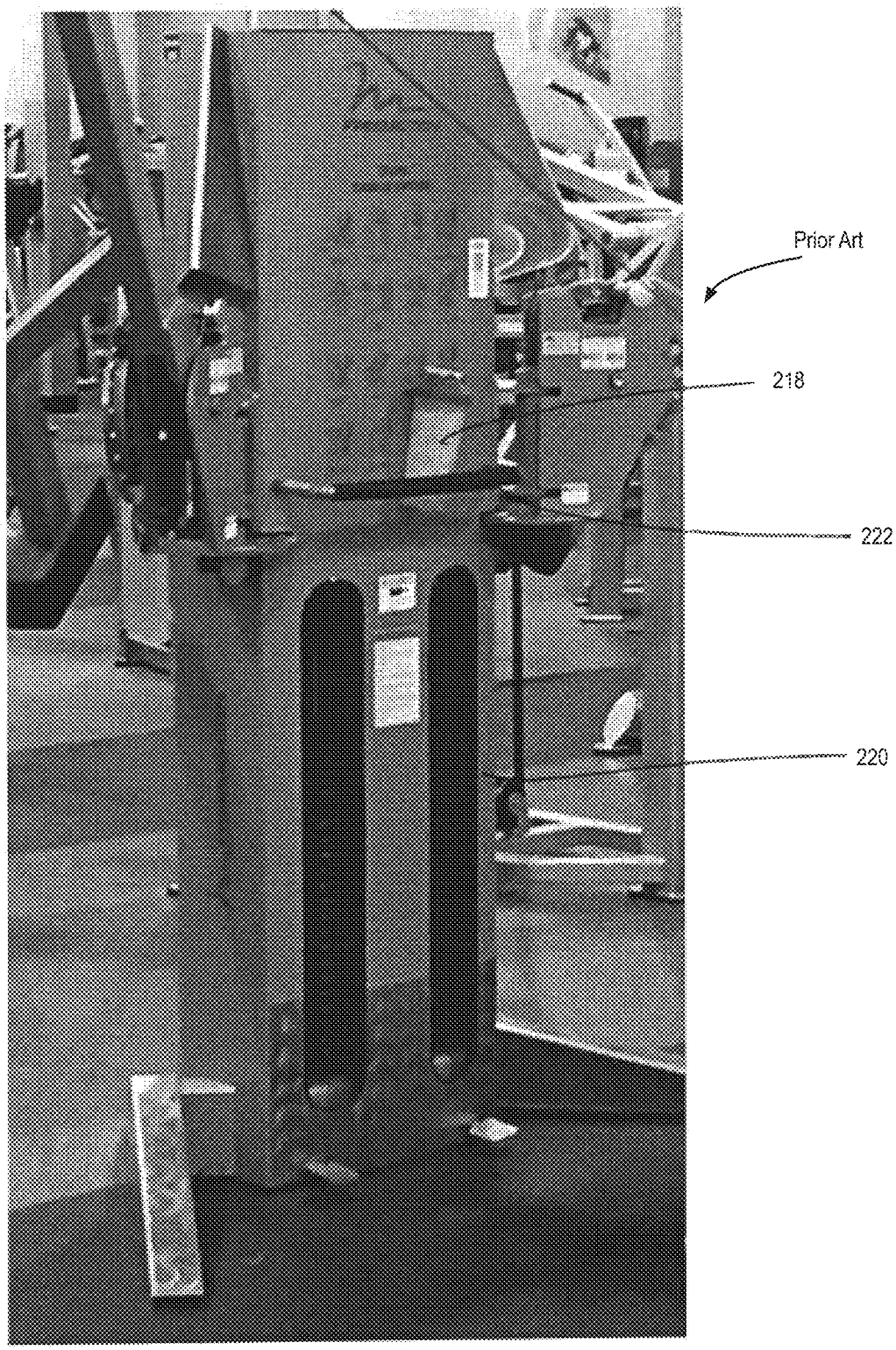
FIG. 11 illustrates a prior art container wedged into an exercise machine.

FIG. 11 illustrates a prior art fluid container 218 wedged into an exercise machine 220. Here, the fluid container 218 is merely wedged into a gap created by the handle 222 of the exercise machine 220. As described previously, bottles may easily be knocked over, dropped, kicked, stepped on, or crushed by the exercise machine 220. When placed on or wedged into the exercise machines 220, the bottles may interfere with the operation of, and cause damage to, the exercise machine 220. Accordingly, with reference to FIG. 5, the body 102 may attach to a magnetic surface at a suspension area. The suspension area may be a section of the body 102, along a longitudinal axis Y-Y, to which the cover 104 and attachment element 130 are attached to the body 102.

With respect to FIGS. 1-5, accordingly, in some embodiments, the cover 104, and attachment element 130, may be centered, with respect to the body 102, at or above a halfway point of the body 102 along longitudinal axis Y-Y (e.g. height), and may be located along a radial axis X-X. In other embodiments, the cover 104 and attachment element 130 may be positioned such that it is above the center of mass of a filled fluid container within the inner volume 116 of the body 102. For example, the attachment element 130 may be positioned above a center height of the body 102. In this way, a suspension area may be configured to prevent the fluid container from becoming free from the body 102 while attached to a magnetic surface. It is to be understood that the above description makes reference to only one attachment element 130 and one cover 104 to provide a simpler conceptual example only. It will be appreciated that in further embodiments, multiple attachment elements 130 and/or covers 104 may be utilized. For example, in one set of embodiments, one or more attachment elements 130 may be distributed to increase the size of the suspension area. In another set of embodiments, one or more attachment elements may be offset to create suspension points around a center of mass of a fluid container. In some embodiments, each of the one or more attachment elements 130 may have a respective cover 104, while in other embodiments more than one attachment element 130 may share a cover 104.

Figure 12:
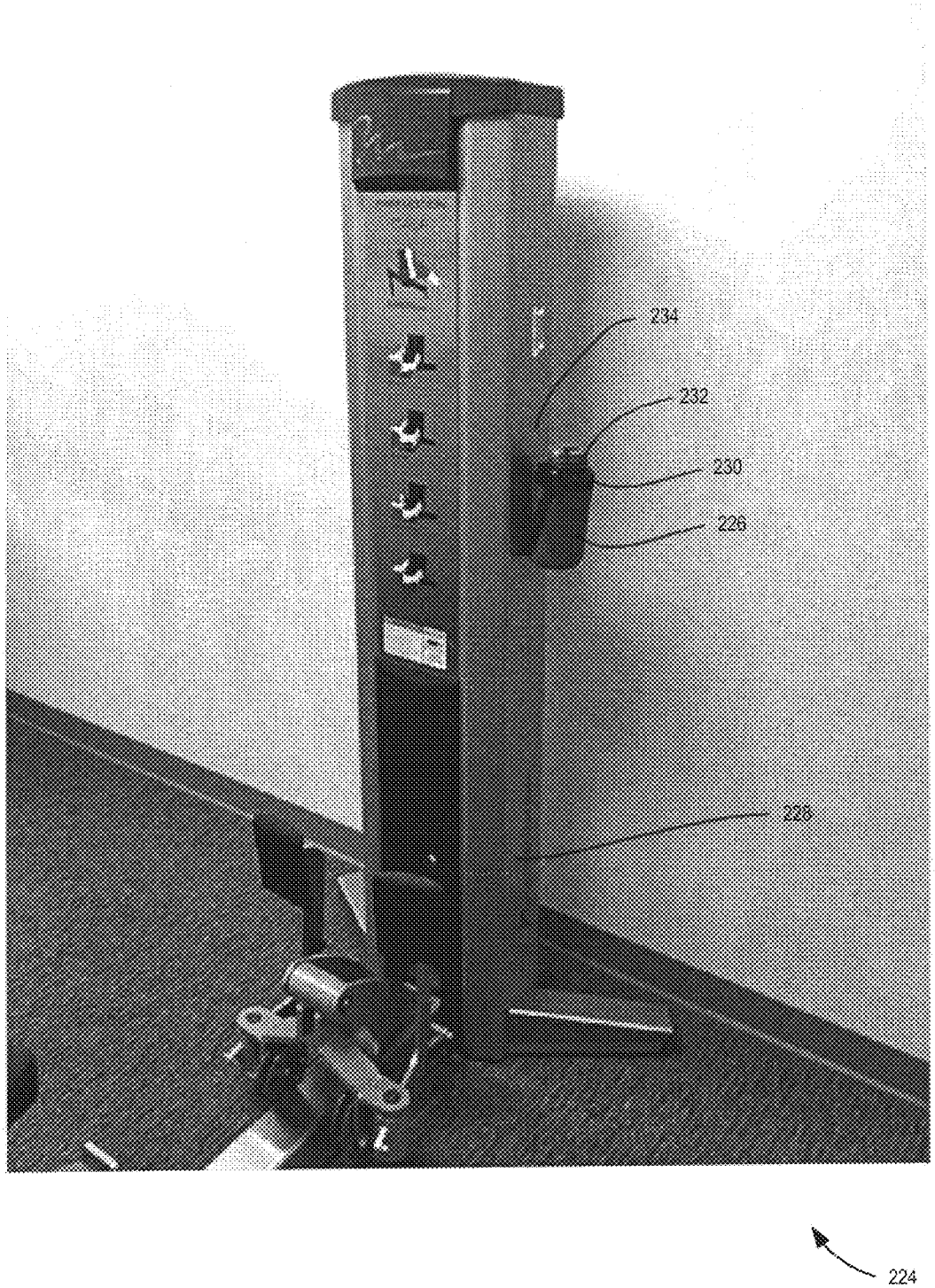
FIG. 12 illustrates the container sleeve of FIG. 1 holding a fluid container and secured to an exercise machine.

With respect to FIGS. 5 and 12, an exercise machine 228 without handles is illustrated. A way to more securely attach a fluid container to an exercise machine is disclosed. FIG. 12 illustrates one implementation of the container sleeve 224 according to various embodiments disclosed. The body 226 of the container sleeve 224 may be configured to hold a fluid container 232. The body 226 may be secured to the fluid container 232 via strap 230. The container sleeve 224 may be suspended from a magnetic surface 234 via an attachment element 130, coupled to the body 226 via a cover 104. In various embodiments, the magnetic surface 234 may, as depicted, be a vertical surface of an exercise machine 228.

Figure 13:
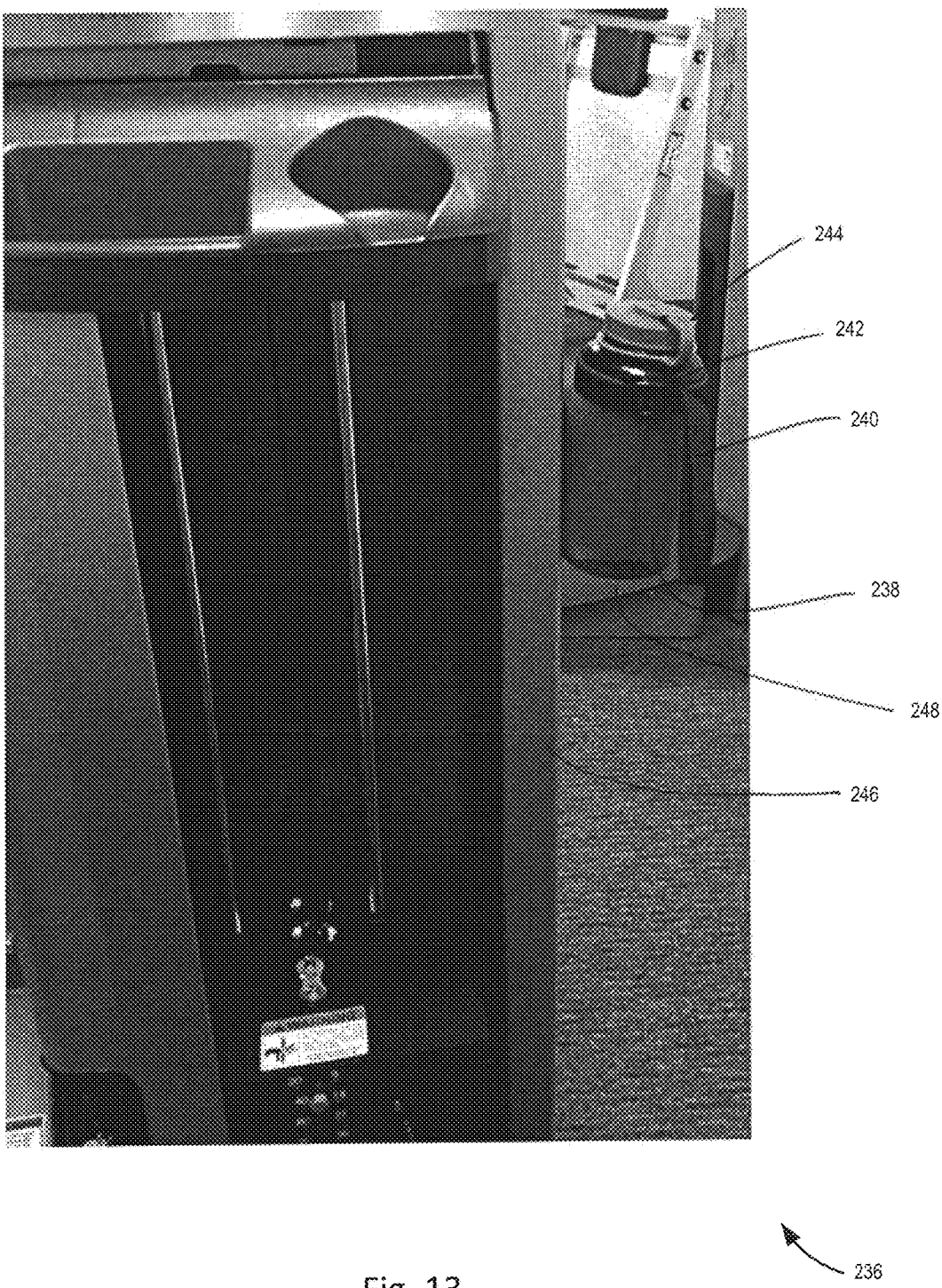
FIG. 13 illustrates an alternate view of one embodiment of a container sleeve of FIG. 1 supporting a fluid container and positioned on an exercise machine.

With respect to FIGS. 5 and 13 an alternative view of container sleeve 236 is provided. The strap 240, adjuster 242, and second cutout 248 are visible. As described above, the second cutout 248 has been stitched or bonded shut, thereby creating an enclosed volume within body 238 for holding fluid container 244. An attachment element 130 provides a pull force between the attachment element 130 and the magnetic surface of 246 of the exercise machine 228.

What is claimed is:

1. A container sleeve comprising:

a body having an interior surface and an exterior surface, the interior surface defining an inner volume that holds a fluid container;

an attachment element coupled to the body, wherein the attachment element exerts a magnetic pull force; and a friction enhancer operably connected to the exterior surface of the body and positioned to at least partially enclose the attachment element, wherein the friction enhancer supports a combined weight of at least the container, the attachment element, and the friction enhancer, and wherein the friction enhancer has a coefficient of friction that is at least a ratio of the combined weight divided by the magnetic pull force and is larger than a coefficient of friction of the exterior surface of the body.

2. The container sleeve of claim 1, wherein the friction enhancer has an elastic modulus and thickness such that when compressed by the magnetic pull force, exerts an elastic force that is less than the magnetic pull force.

3. The container sleeve of claim 1, wherein the body comprises a waterproof lining.

4. The container sleeve of claim 1, wherein the body comprises a porous material.

5. The container sleeve of claim 1, wherein the exterior surface further comprises a recess, wherein the attachment element is disposed in the recess and confined to the recess by the friction enhancer.

6. The container sleeve of claim 1, wherein the exterior surface further comprises a recess, wherein the attachment element is press fit in the recess and confined to the recess by the friction enhancer.

7. The container sleeve of claim 1, wherein the exterior surface is continuous and the attachment element is flush with the exterior surface and confined by the friction enhancer.

8. The container sleeve of claim 1, wherein the attachment element is positioned above a center height of the body.

9. The container sleeve of claim 1, further comprising a cinching mechanism that encloses a top end of the body around the fluid container.

10. The container sleeve of claim 1, wherein the attachment element is disposed within the body, between the interior surface and the exterior surface, and enclosed on a circumferential edge by an edge section, behind by a back section, and in front by a front section.

11. The container sleeve of claim 10, wherein one of the front section, the back section, and the circumferential edge sections of the attachment element is comprised of a magnetic material.

12. The container sleeve of claim 9, further comprising a strap adjuster that adjusts a length of a strap and maintains the length of the strap.

13. The container sleeve of claim 9, wherein the strap adjuster adjusts the length of the strap to close around the container.

14. The container sleeve of claim 12, wherein the strap adjuster is one of a quick release buckle, ladder buckle, ratcheting buckle, or cinch.

15. A container sleeve, comprising:

a body further comprising an interior surface, an exterior surface, and defining an inner volume;

an attachment element connected to the body and exerting a magnetic force sufficient to support the body and a container in a predetermined position; and a cap connected to the body and positioned over a first surface of the attachment element so as to conceal the attachment element from the exterior surface of the body, wherein the cap has a coefficient of friction larger than a coefficient of friction of the exterior surface of the body.

16. The container sleeve of claim 15, wherein the body further comprises a wall defined on either side by the interior surface and the exterior surface, wherein the body further comprises an internal compartment in the wall for receiving the attachment element.

17. The container sleeve of claim 15, wherein the body has a height extending from a bottom end to a top end, wherein the body further comprises an opening, wherein the opening receives the container.

18. The container sleeve of claim 17, wherein the body comprises an at least partially closed bottom surface.

19. A container sleeve comprising:

a cylindrical body having an interior surface and an exterior surface, the interior surface defining an inner volume that holds a fluid container containing a fluid;

the body further comprising an open end and a closed end;

an attachment element coupled to the body, wherein the attachment element exerts a magnetic pull force;

a strap that closes around the container at the open end;

a strap adjuster that adjusts a length of the strap and holds the length of the strap;

a cover attached to the exterior surface of the body and positioned to at least partially enclose the attachment element, wherein the cover supports a combined weight of at least the container, the fluid, the attachment element, and the cover and wherein the cover has a coefficient of friction that is at least a ratio of the combined weight divided by the magnetic pull force, and wherein the cover exerts an elastic force less than the magnetic pull force.

20. The container sleeve of claim 19, wherein the attachment element is disposed within the body, between the interior surface and the exterior surface, and enclosed on a circumferential edge by an edge section, behind by a back section, and in front by a front section.

* * * * *